United States Patent [19]

Glasson

[11] 4,035,578

[45] July 12, 1977

[54] HIGH VOLTAGE ELECTRICAL INSULATORS

[76] Inventor: Geoffrey Thomas Glasson, 56 Waterhouse Avenue, St. Ives, N.S.W. 2073, Australia

[21] Appl. No.: 720,046

[22] Filed: Sept. 2, 1976

Related U.S. Application Data

[63] Continuation of Ser. No. 537,953, Jan. 2, 1975, abandoned.

[30] Foreign Application Priority Data

Jan. 8, 1974 Australia ..... 6182/74

[51] Int. Cl.[2] ..... H01B 17/02; H01B 17/60; H01B 17/62

[52] U.S. Cl. ..... 174/178; 174/209

[58] Field of Search ..... 174/141 R, 141 C, 150, 174/178, 195, 202, 206, 209, 210

[56] References Cited

U.S. PATENT DOCUMENTS

| | | | |
|---|---|---|---|
| 1,198,137 | 9/1916 | Lincoln | 174/209 X |
| 1,241,528 | 10/1917 | Lincoln | 174/209 X |

FOREIGN PATENT DOCUMENTS

| | | | |
|---|---|---|---|
| 1,113,247 | 5/1968 | United Kingdom | 174/209 |
| 1,148,501 | 4/1969 | United Kingdom | 174/209 |

*Primary Examiner*—Laramie E. Askin

[57] ABSTRACT

A high voltage insulator made up of a number of coaxially nested interlocking metal shell-like elements tapered from one end to the other, there being a layer of insulating material arranged between adjacent elements; the elements are each formed with corrugations that are uniformly spaced in the axial direction and have a radial extent greater that the thickness of the insulation, the externally convex portions of the corrugations increase in size from the smaller end to the larger and the externally concave portions correspondingly decrease in size; the thickness of the metal and the thickness of the insulation layer are substantially uniform where the elements overlap and the overlapping surfaces of each element are equi-distant at all places from the surface from any overlapped or overlapping element. The corrugations are annular or helical, in the latter case the elements being screwed together to constitute the insulator.

8 Claims, 5 Drawing Figures

HIGH VOLTAGE ELECTRICAL INSULATORS

This application is a continuation of application Ser. No. 537,953, filed Jan. 2, 1975, now abandoned.

The present invention relates to high voltage insulators and in particular to insulators required to have also a high degree of structural strength.

Insulating materials having superior electrical properties generally have relatively poor mechanical properties. This invention relates particularly to high voltage electrical insulators in which the electrical and mechanical functions are separated so that the most suitable materials can be utilised to satisfy each function. A further feature is that only a relatively small voltage occurs across each element of the insulator.

Designs of structural high voltage insulators have been proposed which consist of an assembly of a number of flanged insulating elements, which may be reinforced with internal metal shells, nested together. In these designs the sides of the elements are tapered or stepped inwards from the flanged end to the smaller diameter end, adjacent elements being directly bonded either by an adhesive or by a screw thread formed in the insulating material.

The disadvantages of these systems are that the entire applied tensile load must be resisted by the bond between each pair of adjacent elements and hence a failure of any one bond would result in the failure of the complete assembly.

Also, the applied tensile load must be transferred from element to element mainly via shear and tensile forces in the insulation. The shear and tensile strengths of most insulating materials having good electrical and weather resistant properties are relatively poor hence limiting the maximum applied tensile load which may be applied to the assembly.

The present invention seeks to overcome these shortcomings of known insulators.

The present invention consists in a high voltage insulator consisting of a plurality of coaxially nested interlocking metal shell-like elements, each having an overall taper from one end to the other and fitting closely within or about an adjacent element, a layer of insulating material being interposed between adjacent elements, characterised in that;

a. the elements are formed with corrugations having a uniform spacing in the axial direction, b. the externally convex portions of the corrugations in each element increase in size in going in an axial direction from the smaller end to the larger, and the externally concave portions thereof correspondingly decrease in size, c. the radial extent of each corrugation is greater than the thickness of the layer of insulation, d. the wall thickness of the elements and the thickness of the layer of insulation are both substantially uniform where the elements overlap, e. the overlapping or overlapped surface of each element is equi-distant at all places from the surface of any overlapped or overlapping element.

In order that the invention may be better understood and put into practice, preferred forms thereof are hereinafter described by way of example with reference to the accompanying drawings in which.

Figure 1:
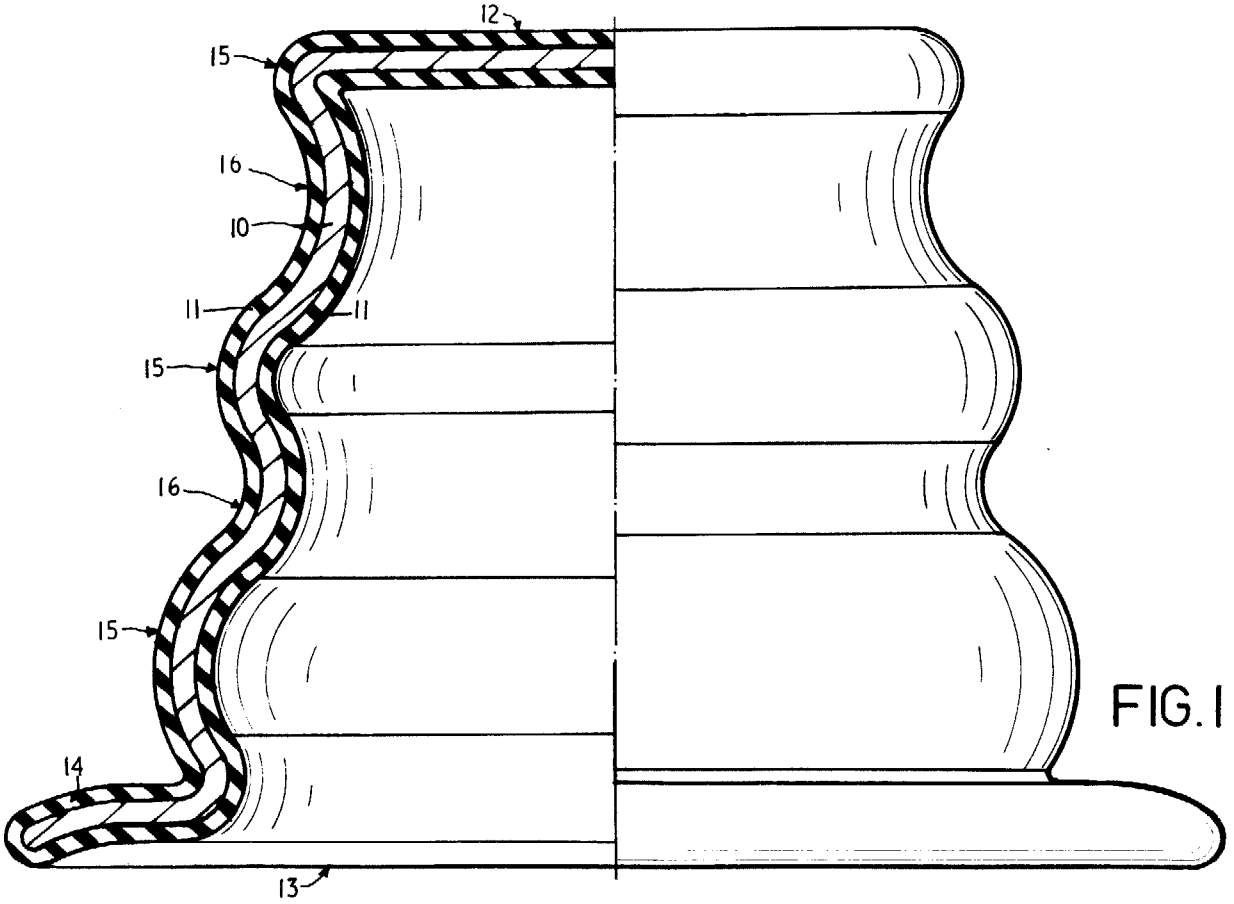
FIG. 1 is a part-sectional elevation of one form of element for assembly into an insulator according to the invention.
Figure 2:
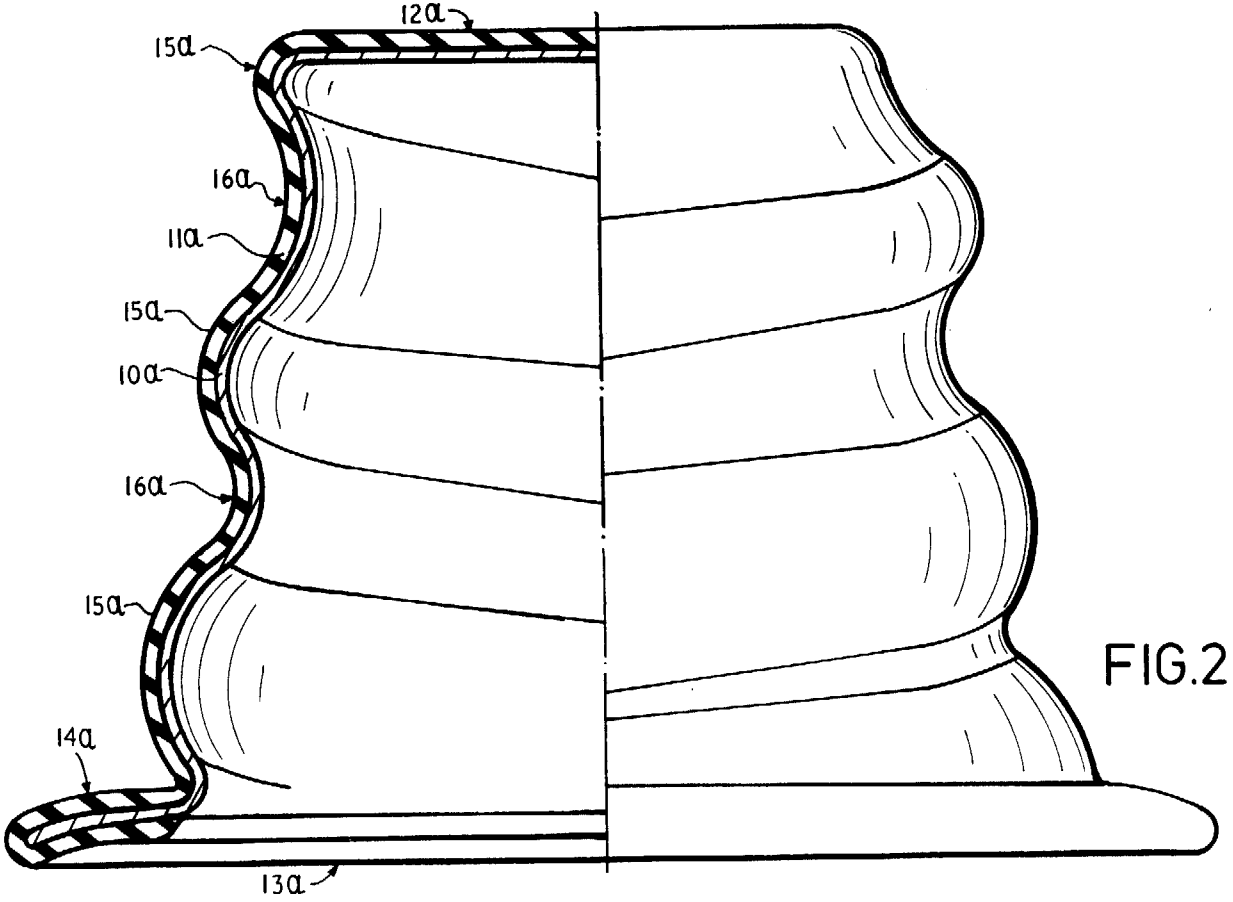
FIG. 2 is a similar view of a second form of element.

The preferred forms of element shown in FIGS. 1 and 2, from an assembly of either of which a high voltage insulator can be constructed, consist of a tapering metal shell 10 or 10*a* which is covered on one (10*a*) or both (10) sides with suitable insulating material 11 or 11*a*. The thickness of the metal and insulation are both essentially uniform at all places where the elements overlap when assembled.

One end of each element, hereafter referred to as the top end 12 or 12*a* has a circumferential length smaller than the other end, hereafter referred to as the bottom end 13 or 13*a*. The top end may be either closed as shown in the drawings or open. The bottom end, which is open, has an external flange 14 or 14*a*, although this is not essential.

Each element has a plurality of corrugations defined by ridges 15 or 15*a* of uniform axial pitch or spacing but of varying size such that the externally convex portions increase in size uniformly from the top to the bottom while the intervening externally concave portions 16 or 16*a* decrease in size uniformly. This change of size is reflected in the corresponding internal convex and concave portions. The outward projection of the ridges from the body of the element is greater than the thickness of insulation 11 or 11*a* on the element.

Whereas in both FIG. 1 and FIG. 2 the element consists of a generally tapering metal shell with the feature described above, the main difference between these constructions lies in the fact that in FIG. 1 the ridges 15 are annular whereas in FIG. 2 they are in the form of a tapered helix of constant axial pitch but with uniformly increasing radius of the exteriorly convex parts and an equally decreasing radius of the exteriorly concave parts from the top of the element to the bottom.

In both forms of element illustrated, owing to the uniform wall thickness, the shape of the internal surface of the element corresponds to the shape of the external surface with the consequential alteration of the radii (as seen in axial cross-section) of the internally concave and convex portions.

Figure 3:
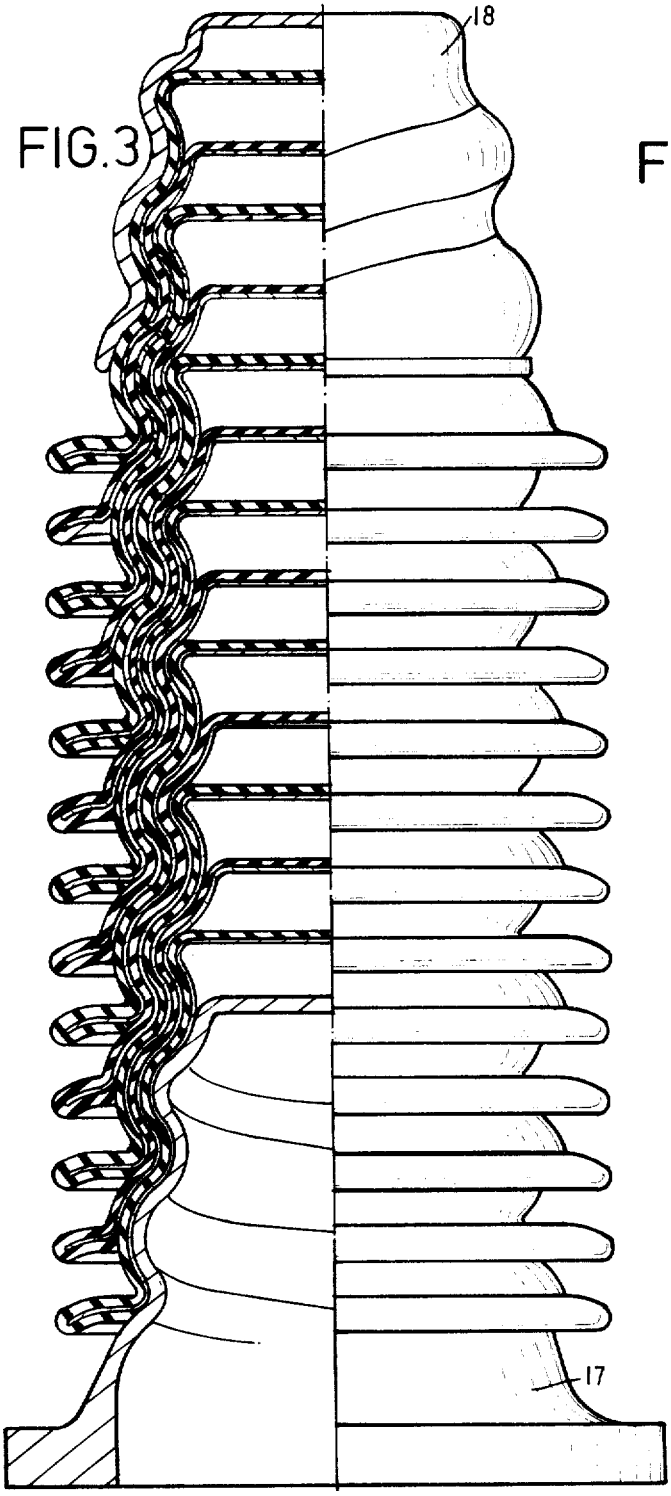
FIG. 3 is a part-sectional elevation of an insulator constructed according to the invention made up from elements shown in FIG. 2.
Figure 5:
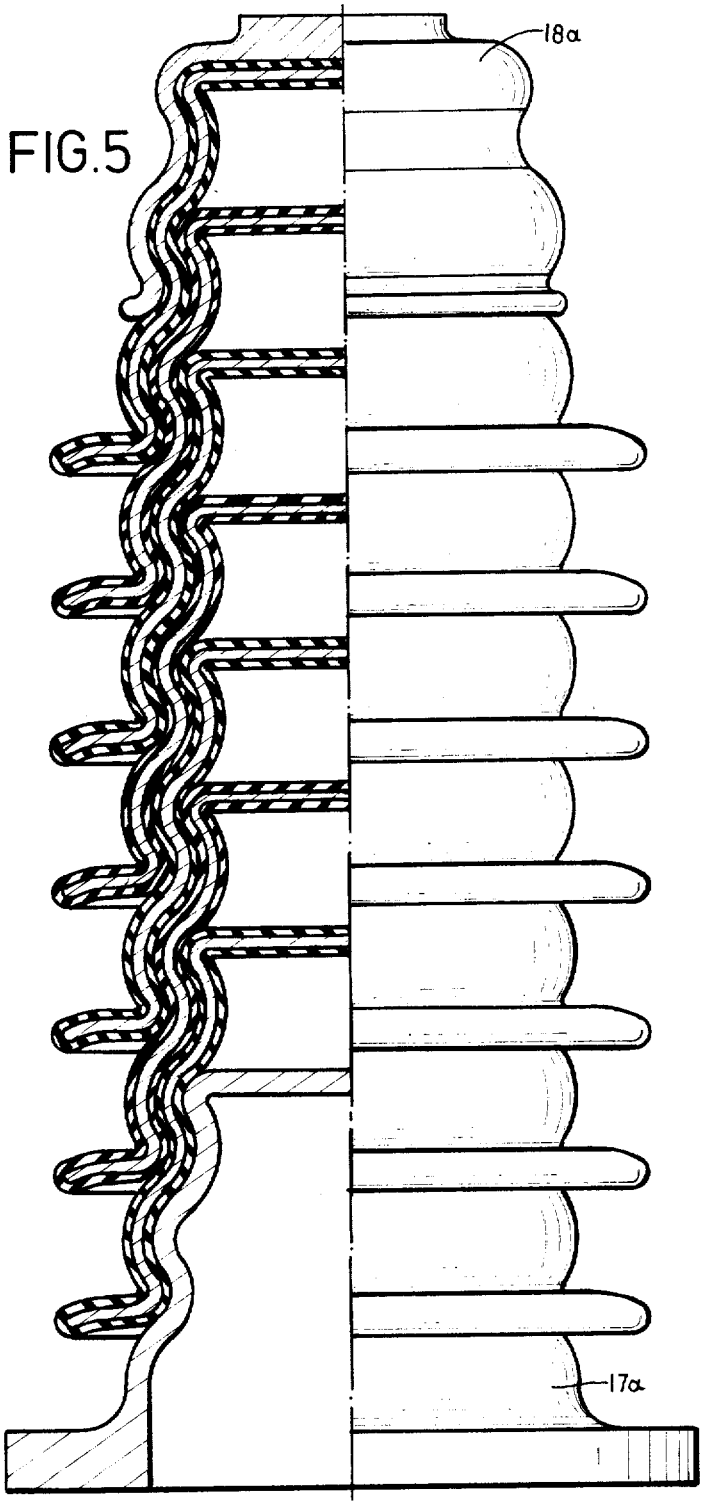

The shape of each element is such that when assembled as illustrated by way of example in FIG. 3 and FIG. 5, which represent, respectively, an assembly of the elements shown in FIG. 2 and FIG. 1, the overlapping or overlapped surface of any element is equi-distant at all places from the surface of any overlapped or overlapping element, the separation between any two adjacent metal elements being equal to the thickness of insulation on one element; and in this sense the surfaces of any element are parallel to the surfaces of all the overlapping elements.

It might appear from FIG. 3 that elements of the two different shapes are used due to the fact that, owing to the geometry of the particular elements used, the plane of the section is displaced by 180° for alternate elements.

Although a single lead helix is shown in FIGS. 2 and 3, multiple lead helices can be used and also other shapes of the helix subject to the restriction that the shape and radial distance at any point on the sides of the metal elements are identical to that on an imaginary suface equi-distant at all places from the surface of the element at any other point on the same helical path, the spacing between the two surfaces being proportional to the total angle swept around the axis in moving along the helical path from one point to the other.

Prior to assembly, a suitable insulating material is applied to one side of the elements as shown in FIGS. 2 and 3 or to both sides as shown in FIGS. 1 and 5. It can be moulded separately and then screwed on to the metal elements or formed directly on the elements. As the insulating material will be relatively free from mechanical functions, it can be selected to have optimal electrical and weathering properties and may be of any suitable material such as an elastomer, thermo-plastic, resin or ceramic.

Insulators of any required voltage rating can be formed from the appropriate number of elements. Due to the various shapes which may comply with the specified requirements for the elements, various methods of assembly are possible. The elements shown in FIG. 1 may be initially formed to such a shape that with its insulation layer each will fit into a fully formed element. The element can then be expanded to its final shape as shown in FIG. 1 locking it into position into the previous element. The assembly of a complete insulator as shown in FIG. 5 would involve a repetition of this process.

With elements of the kind shown in FIG. 2, each element in turn is screwed inside the preceding element with the appropriate torque. As successive elements are screwed into place, the compressive loading in the insulating material increases so that the resistance to unscrewing of the completed assembly is much higher than the torque required to screw in each element.

Metal end fittings 17 and 18 illustrated by way of example in FIG. 3 and 17*a* and 13*a* in FIG. 5, are inserted inside and outside the bottom and top, respectively, of the assembled elements, the surfaces adjacent to the elements being of a corresponding shape.

Many variations in the form of elements are possible within the scope of the invention, provided the essential features are present. For example, the circumference of some forms of element is not restricted to a circular shape, the ridges and corrugations need not be continuous around the full circumference, and the shapes of the metal elements and insulation on those parts which do not overlap adjacent elements are variable within the terms of the preceding description.

As will be appreciated from the preceding description, the same portions of an element which interlock with an exteriorly overlapping element, may also directly interlock with an interiorly overlapping element thus providing for a direct transfer of mechanical forces across that element with that portion of the element subject only to essentially compressive forces.

Figure 4:
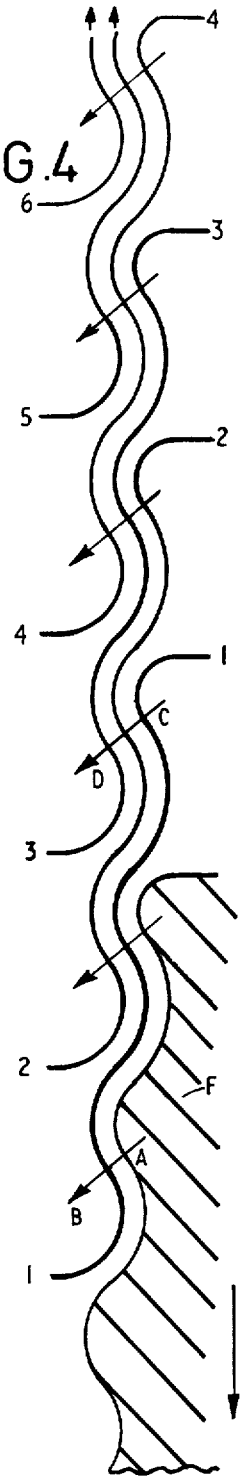
FIG. 4 illustrates diagrammatically the interaction of individual elements making up the insulators of FIGS. 3 and 5 and, FIG. 5 is a part-sectional elevation of an insulator constructed according to the invention made up from elements shown in FIG. 1.

When an axial tensile load is applied between the end fittings, the internal forces operating within the assembly may be described as follows with reference to FIG. 4 which represents schematically part of a longitudinal section of the insulator.

Due to the outward shape at point A on the lower end fitting and the corresponding slope at point B on the lower part of element 1, part of the applied load is transferred through the insulation to element 1 in the direction shown by the arrow. The radial component of this load is balanced by other radial components around the circumference of the element but the longitudinal component is transferred as a tensile force along the metal of element 1 to its upper projection at point C. At this point the force is transferred in a similar manner to element 3. The metal of element 2 and the insulation between points C and D is primarily subject to equal and opposite compressive forces from elements 1 and 3. Hence there is no transfer of longitudinal forces to the insulation or element 2 at this point by this effect. Depending on the degree of friction between adjacent elements, there may be some transfer of load by that effect but this is not essential to the operation of the insulator assembly.

Element 3 will similarly transfer the load to element 5 and eventually the load will be transferred to the upper end fitting. In parallel with the transfer of load there is also a transfer from the lower end fitting F to element 2 and thence to element 4, thence 6 and so on the upper end fitting (not shown) in a similar manner.

In general there will be a number of parallel systems transferring load from one end fitting to the other depending on the number of projections per element in the axial direction, the axial length of such element and the spacing between adjacent elements in the assembly.

In the construction described, the insulator thus formed will have high mechanical strength due to the large number of metal surfaces in parallel and the interlocking of one with another. Due to this arrangement, the tensile loads are taken by the metal elements, while the insulating material is subject only to moderate compression between parallel surfaces and to a small extent shear forces which depend on the coefficient between the insulating material and the metal.

The insulator assembly described will perform in a similar manner with applied compression loads or in bending where one side will be in tension and the other in compression. Hence it is suitable for use with all types of applied loads.

The following points in connection with the invention are worthy of note:

1. The electrical strength of thin layers of insulation may be higher than that of thicker layers when measured in terms of voltage per thickness. Hence, by subdividing the voltage across a large number of thin layers a relatively small total thickness of insulation is required.

2. All joints between various parts of the complete assembly are along equi-potential surfaces. Hence, the device does not rely on perfect sealing against the ingress of moisture.

3. As the electrical capacitance between adjacent elements is relatively high compared to that in conventional insulators, effective division of voltage will be achieved between all the elements. This will result in superior electrical strength for both steady and impulse voltages. Due to this effective grading of voltage, the insulator may also have superior resistance to flashover resulting from surface comtamination of the insulating material than conventional insulators.

4. The insulators can be made in any length without the necessity for intermediate fittings. Due to this feature and the inherently high electrical strength, the length of insulator can be smaller than conventional insulators. The insulators can be used as tension or compression units but due to their high section modulus are particularly suitable for beam units where considerble resistance to bending is required. With moderately flexible insulating material the insulators will have a relatively high resistance to shock loading.

With the above features, the use of these insulators as structural members makes practicable the use of transmission structures having smaller overall dimensions compared to conventional structures.

The principles discussed are also extended to the assembly of other high voltage apparatus such as equipment bushings and surge diverters. In these types of equipment the inherent uniform division of voltage between successive elements is of particular advantage.

In certain applications of the invention the coating of parts of the insulating material with conducting material (such as conducting paint) may be carried out with advantage.

I claim:

1. A high voltage electrical insulator consisting of a plurality of coaxially nested interlocking metal shell-like elements, each having an overall taper from one end to the other and fitting closely within or about an adjacent element, a layer of insulating material being interposed between adjacent elements, the elements being formed with corrugations having a substantially uniform spacing in the axial direction, the externally convex portions of the corrugations in each element increasing in size in going in an axial direction from the smaller end to the larger, and the externally concave portions thereof correspondingly decreasing in size, the radial extent of each corrugation being greater than the thickness of the layer of insulation, the wall thickness of the elements and the thickness of the layer of insulation being both substantially uniform where the elements overlap, the overlapping or overlapped surface of each element being substantially equi-distant from the surface of any overlapped or overlapping element.

2. A high voltage electrical insulator as claimed in claim 1 wherein the corrugations are discontinuous in a circumferential direction.

3. A high voltage electrical insulator as claimed in claim 1 wherein each element is closed at the smaller end.

4. A high voltage electrical insulator as claimed in claim 1 wherein each element has an outwardly extending flange at the larger end.

5. A high voltage electrical insulator as claimed in claim 1 which comprises end fittings fitted into or onto the end elements of the insulator.

6. A high voltage electrical insulator consisting of a plurality of coaxially nested interlocking metal shell-like elements, each having an overall taper from one end to the other and fitting closely within or about an adjacent element, a layer of insulating material being interposed between adjacent elements, the elements being formed with corrugations having a substantially uniform spacing in the axial direction, the externally convex portions of the corrugations in each element increasing in size in going in an axial direction from the smaller end to the larger, and the externally concave portions thereof correspondingly decreasing in size, the radial extent of each corrugation being greater than the thickness of the layer of insulation, the wall thickness of the elements and the thickness of the layer of insulation being both substantially uniform where the elements overlap, the overlapping or overlapped surface of each element being substantially equi-distant from the surface of any overlapped or overlapping element, said corrugations being in the form of at least one tapered helix of constant axial pitch but with uniformly varying shape such that the shape and the radial distance at any point on the sides of the elements are identical to that of a surface parallel to the surface of the element any any other point on the same helical path, the spacing between the two surfaces being proportional to the total angle swept around the axis in moving along the helical path from one point to the other.

7. A high voltage electrical insulator as claimed in claim 6, wherein the corrugations are discontinuous in a circumferential direction.

8. A high voltage electrical insulator consisting of a plurality of coaxially nested interlocking metal shell-like elements, each having an overall taper from one end to the other and fitting closely within or about an adjacent element, a layer of insulating material being interposed between adjacent elements, the elements being formed with corrugations having a substantially uniform spacing in the axial direction the externally convex portions of the corrugations in each element increasing in size in going in an axial direction from the smaller end to the larger, the externally concave portions thereof correspondingly decreasing in size, the radial extent of each corrugation being greater than the thickness of insulation along portions where the elements overlap, and each element other than the elements at each end of the insulator having a portion along its length that interlocks with an adjacent exteriorly overlapping element and also interlocks with an adjacent interiorly overlapping element whereby there is a direct transfer of mechanical forces across each element.

* * * * *